US008354929B2

(12) United States Patent
Herdic et al.

(10) Patent No.: US 8,354,929 B2
(45) Date of Patent: Jan. 15, 2013

(54) INTRUDER DETECTOR AND CLASSIFIER

(75) Inventors: Peter C Herdic, Washington, DC (US); Robert M Baden, Yamaguchi (JP); Brian H Houston, Fairfax, VA (US); Phillip A Frank, Laurel, MD (US); Alain R Berdoz, Annandale, VA (US); Jeff M Byers, Fairfax Station, VA (US)

(73) Assignee: The United States of America, as respresented by the Secretary of the Navy, Washington, DC (US)

( * ) Notice: Subject to any disclaimer, the term of this patent is extended or adjusted under 35 U.S.C. 154(b) by 546 days.

(21) Appl. No.: 12/555,918

(22) Filed: Sep. 9, 2009

(65) Prior Publication Data

US 2010/0085188 A1 Apr. 8, 2010

Related U.S. Application Data

(60) Provisional application No. 61/095,425, filed on Sep. 9, 2008.

(51) Int. Cl.
*G08B 13/00* (2006.01)

(52) U.S. Cl. ..... 340/566; 340/565; 340/551; 340/541; 367/118; 367/124

(58) Field of Classification Search ..... 340/551, 340/565, 566, 541; 367/118, 124
See application file for complete search history.

(56) References Cited

U.S. PATENT DOCUMENTS

| | | | | |
|---|---|---|---|---|
| 4,110,730 | A * | 8/1978 | Varecka et al. | 367/135 |
| 4,122,432 | A * | 10/1978 | Triebold et al. | 367/135 |
| 4,415,979 | A * | 11/1983 | Hernandez | 702/56 |
| 6,668,619 | B2 * | 12/2003 | Yang et al. | 73/40.5 R |
| 7,034,716 | B2 * | 4/2006 | Succi et al. | 340/935 |
| 2005/0251343 | A1 * | 11/2005 | Zehavi | 702/18 |
| 2009/0115635 | A1 * | 5/2009 | Berger et al. | 340/943 |
| 2009/0309725 | A1 * | 12/2009 | Berger et al. | 340/566 |

* cited by examiner

*Primary Examiner* — Hung T. Nguyen
(74) *Attorney, Agent, or Firm* — Amy L. Ressing; Kerry L. Broome

(57) ABSTRACT

A method and system for detecting and classifying intruders is provided. A noise threshold can be determined and set based on background noise. A seismic sensor can be configured to receive a plurality of seismic data signals. A microcontroller can be configured to count the number of times the noise threshold is exceeded over a defined time interval by the plurality of seismic data signals, and then detect and classify the presence of an intruder based on the count. Additionally, an amplitude evaluation module can be configured to determine a signal amplitude for the seismic data signals associated with the detected intruder and compare the detected intruder signal amplitude to known signal amplitudes in order to determine a sub-type of the intruder. Finally, a transmission source can be configured to transmit intruder detection and classification information to a remote location.

13 Claims, 4 Drawing Sheets

INTRUDER DETECTOR AND CLASSIFIER

CROSS-REFERENCE TO RELATED APPLICATIONS

This application claims priority to provisional patent application entitled, "Intruder Detector and Classifier," filed on Sep. 9, 2008, and assigned U.S. Application No. 61/095,425; the entire contents of which are hereby incorporated by reference.

FIELD OF THE INVENTION

The invention relates generally to an intruder detector and classifier. More particularly, the invention relates to an ultra low power consumption intruder detector and classifier with a low false alarm rate and the ability to discriminate between intruder types through a threshold-based counting methodology.

BACKGROUND

The monitoring of intruders usually employs some form of unattended ground sensor (UGS). These sensors can be different depending on their intended application. For example, seismic/acoustic sensors can take advantage of changes of the vibratory seismic motion in the ground and/or sound field resulting from an intruder. Differences in the magnetic field due to ferrous metals can be detected by magnetic sensors. Infrared sensors can detect changes due to a passing heat source. Video and still image systems can be used for a positive visual identification. These different systems are typically used for detecting and monitoring intruder movements, obtaining bearing information and identification.

In the conventional art, seismic/acoustic sensors have been used for many years to monitor the movements of targets in the battlefield. These systems are traditionally used to detect large targets such as troops, wheeled vehicles, and tanks. In more recent years, the significance of the seismic/acoustic sensors have grown as applications have increased to include smaller targets on remote foot paths, the protection of military installations/checkpoints, immigration control on geographical borders, monitoring of airfields, vehicle traffic on roads and highways, etc.

While simply detecting an intruder with a seismic sensor can be fairly straightforward with a strong signature, separating the signature of a stealthy intruder from noise can be very difficult. Often, some sort of confirmation is needed when the detection is made with these seismic signatures. For example, this confirmation can involve turning on cameras with high power consumption or the deployment of personnel to investigate the signature. In either case, the costs can be considerable for false detections.

Intruder systems typically employ a range of methodologies from simple threshold detection to more complex identification logic. Simple threshold approaches that detect intruders immediately after the threshold is exceeded are unacceptable because they frequently lead to false alarms and/or stealthy intruders eluding detection. Furthermore, frequency and time-frequency domain approaches have been proposed; however, they are highly computational. Other high performance identification methods such as matched pursuits or relevance vector machines (RVM) have also been proposed, but the computational nature of these methods is not consistent with the low power requirement for long duration deployments.

Accordingly, there remains a need for a method and system for detecting and identifying intruder activity from seismic vibratory motion that solves the problems of previous detection devices by: (1) providing a system with high sensitivity to detect stealthy targets; (2) maintaining a low false alarm rate; (3) distinguishing between the signatures of different intruders for identification; (4) implementing an approach that is simple so that power consumption is very low; (5) employing a method that is adaptable to different and changing noise environments; and (6) providing a simple and automated deployment procedure.

SUMMARY OF THE INVENTION

To date, detecting and identifying intruder activity from seismic vibratory motion has been hindered by a high false alarm rate and an inability to successfully discriminate between intruder types, such as human versus vehicle traffic. In addition, there are no low-cost and ultra low power systems to perform these tasks. The invention satisfies the above-described and other needs by providing a system and method that can detect and identify intruder activity with a system that provides high sensitivity to stealthy targets, while maintaining a low false alarm rate in a low power consumption device.

For one aspect of the invention, a noise threshold can be determined and set based on background noise. A seismic sensor can be configured to receive a plurality of seismic data signals. A microcontroller can be configured to count the number of times the noise threshold is exceeded over a defined time interval by the plurality of seismic data signals, and then detect and classify the presence of an intruder based on the count. Additionally, an amplitude evaluation module can be configured to determine a signal amplitude for the seismic data signals associated with the detected intruder and compare the detected intruder signal amplitude to known signal amplitudes in order to determine a sub-type of the intruder. Finally, a transmission source can be configured to transmit intruder detection and classification information to a remote location.

These and other aspects, objects, and features of the present invention will become apparent from the following detailed description of the exemplary embodiments, read in conjunction with, and reference to, the accompanying drawings.

DETAILED DESCRIPTION OF EXEMPLARY EMBODIMENTS

Figure 1:
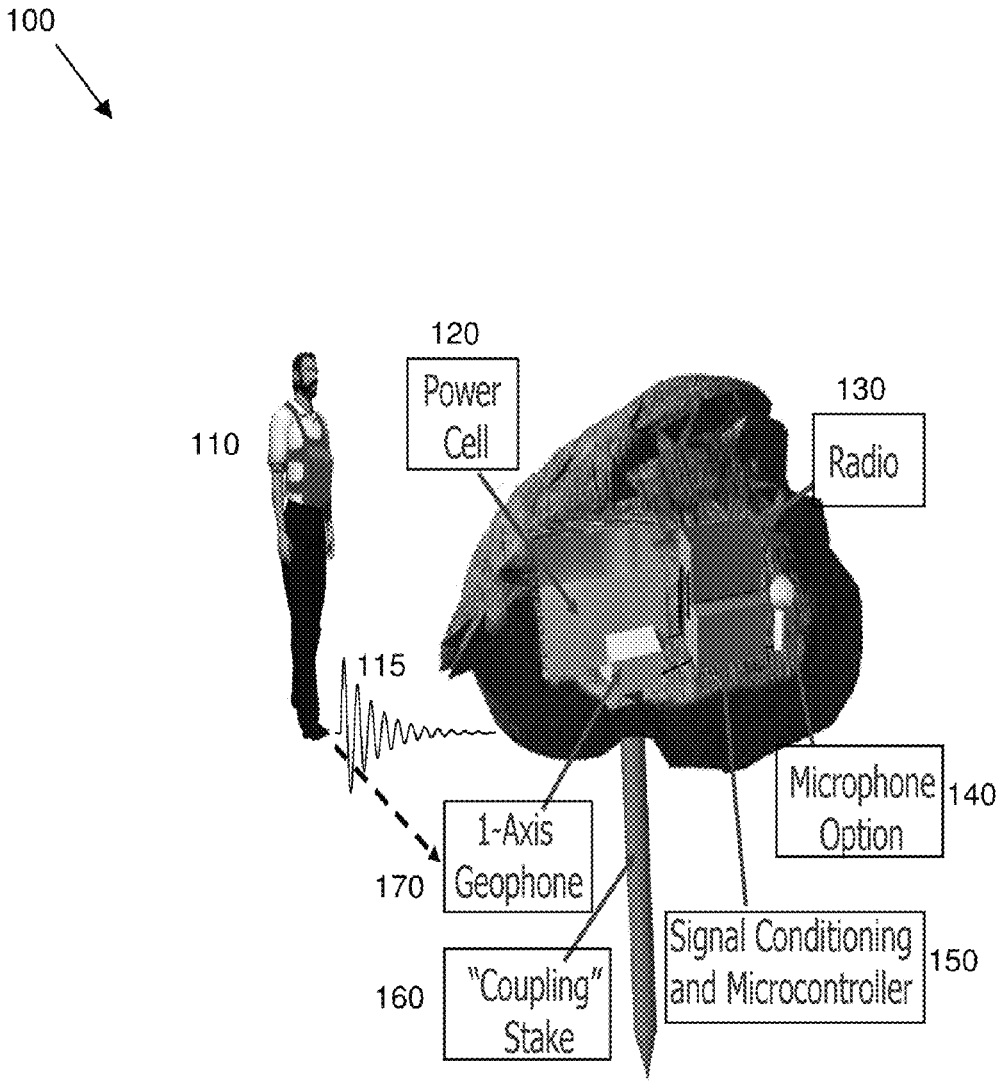
FIG. 1 is a block diagram of an intruder detector and classifier system.

Referring now to the drawings, in which like numerals represent like elements, aspects of the exemplary embodiments will be described in connection with the drawing set.

FIG. 1 is a block diagram of an intruder detector and classifier system 100. This exemplary system 100 can have a number of widespread applications, including, but not limited to, the following monitoring applications: troop and terrorist movements in the field and along foot paths; drug trafficking activity for interdiction; geographic boarders and illegal immigration; vehicle traffic on roads and highways; aircraft runways; protection of oil rigs; livestock protection; and security of manufacturing and/or farming equipment. In one example embodiment of using the system 100 for human traffic movements along foot trails, the device can be camouflaged as a rock to blend in with its current surroundings. The device can then detect the human footfalls of the intruder and radio this information to a remote location for interdiction.

In accordance with an exemplary embodiment of the intruder detector and classifier system, the basic system functionality and device hardware are illustrated in FIG. 1. A human intruder 110, for example, is shown exciting a response (represented in FIG. 1 by the wavy lines 115) in the ground which is observed by a seismic sensor 170 at some distance away. In an exemplary embodiment of the invention, the seismic sensor can be an in-plane, 1-axis geophone. In an exemplary embodiment of the invention, a Geospace Technologies GS20-DM can be utilized for the geophone 170. In an alternative embodiment, a two-axis or three-axis seismic sensor can be utilized. A coupling stake 160 can be used to rigidly couple the geophone 170 to the ground motion.

The seismic signal 115 can be amplified, low-pass filtered, converted from analog to digital, and sent to a microcontroller 150. Additional hardware (i.e., signal conditioning elements) for amplifying, filtering, and converting the seismic signal from analog to digital are not represented in FIG. 1; however, this hardware is known to one of ordinary skill in the art in seismic signal detection. The microcontroller 150 can include computer software instructions for implementing a threshold-based counting methodology in accordance with an exemplary embodiment of the invention, and as discussed in reference to FIG. 2. In an exemplary embodiment of the invention, a Texas Instruments model MSP430F427 can be utilized for the ultra-low powered microcontroller 150.

The intruder detector and classifier system 100 can include additional hardware and software features. For example, a radio 130 can be provided to communicate the detection and identification results to a remote location. For example, the detection and identification results can be communicated to troops on the ground that may be monitoring the areas for insurgents. The communicated information can include information about the type and numbers of the intruders, as well as location information for tracking of the intruders.

In another embodiment, a microphone 140 can be included in the intruder detector and classifier system 100 as an additional sensing option. For example, the microphone 140 can be especially useful in the detection and identification of aircraft and boat traffic where acoustic signal levels are typically high.

In order to power the intruder detector and classifier system 100, a power cell 120 is included. The power cell 120 can be required by the signal conditioning elements and microcontroller 150, microphone 140, and radio 130. It should be understood by one of ordinary skill in the art that the geophone itself is a passive device, requiring no power. In an exemplary embodiment of the invention, the signal conditioning elements and microcontroller 150 can have a power budget of 5.5 mW at 100% duty cycle and the radio 130 can have a power budget of 100 mW at 0.5-2.0% duty cycle.

Low power consumption is necessary to ensure that the device can function over several months without recharging or replacing. In an exemplary embodiment of the invention, an AA-size Lithium batter can be utilized as the power cell 120. Based on the low power utilized by the system, the example AA-size Lithium battery can have long lifetime expectancy, such as up to 50 days. Longer lifetimes can be achieved with larger cells or battery packs. Furthermore, self-charging power cells, such as solar cells can also be utilized. It should be noted that as technology advances in the future, more processing capability will be possible with even lower power consumption, thus allowing more sophistication to be easily added to this system.

In an alternative exemplary embodiment of the invention, the seismic sensor 170 could also be implemented with other sensor technologies such as, but not limited to, acoustic microphones, thermal infrared sensors and magnetometers. Furthermore, combinations of different sensor technologies can be used to complement each other, forming more powerful and reliable systems. For example, seismic and infrared sensors could be combined to complement each other. In a rain storm, a seismic sensor can become saturated, or blinded, by ground vibration noise generated by the falling rain; however, an infrared sensor could still pick up an associated heat source. On the other hand, the infrared sensor might be blinded on a very hot day; however, the seismic sensor could be better suited to perform the intruder detection and identification in that situation.

Figure 2:
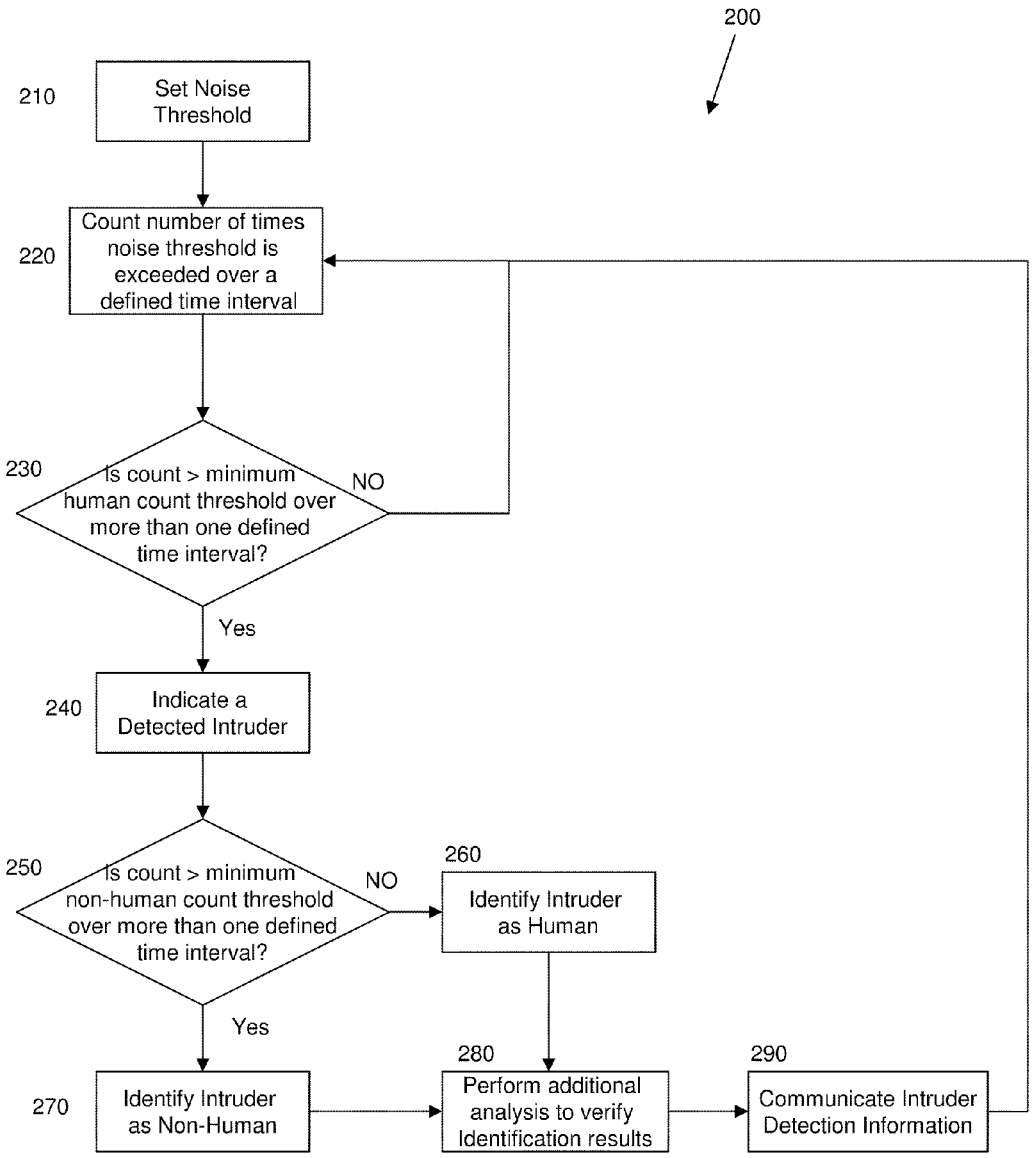
FIG. 2 is a flow chart illustrating an exemplary method for detecting and classifying intruder types in accordance with an exemplary embodiment of the invention.

FIG. 2 is a flow chart illustrating an exemplary method 200 for detecting and classifying intruder types in accordance with an exemplary embodiment of the invention. The method comprises a threshold-based counting methodology that performs the detection and identification of intruder activity. This process can be performed by the microcontroller 150 that is configured with computer programmed instructions.

In Step 210, a noise threshold is set. The noise threshold represents a particular seismic signal setting for which any seismic signals greater than the noise threshold may indicate the presence of an intruder(s). Step 210 is accomplished by setting the noise threshold through a measurement of the background environmental noise (i.e., the seismic sensor measurement where no intruder is present). Based on the noise data readings of the background environmental noise, the data can be rectified, averaged, and then, a multiplier can scale the data to set the noise threshold level. The multiplier can be determined empirically based on the different types of environment, distances, intruders, etc. One of ordinary skill in the art will understand that a multiplier is utilized to distinguish the noise threshold value for intruders from typical background noises such as wind noise. In one embodiment, the noise threshold level can be updated periodically to ensure accuracy and functionality of the device in a changing environment with variable background noise. For example, the background noise differences between day and night.

After setting the noise threshold, the device can be left in an appropriate location to begin receiving seismic signals. After the device has been left in a location, the geophone 170 will begin receiving discrete seismic data signals that can flow into the microcontroller 150. In Step 220, the microcontroller 150 can count the number of times the noise threshold is exceeded over a defined time interval. By way of example, and as implemented and disclosed herein, the defined time interval can be a single two second interval with a sample rate of 5 kHz. Other defined time intervals with different sample rates can also be utilized. Step 220 can be continuously repeated over multiple defined time intervals, such as the two second intervals.

In Step 230, it can be determined whether the count exceeds a minimum human count threshold value for more than one consecutive time interval. For example, a minimum human count threshold and a minimum non-human count threshold can be defined. The detection methodology of the present invention allows the minimum thresholds to be set at low values for the detection of stealthy intruders while not increasing the false alarm rate. In practice, the specific minimum threshold counts for humans and non-humans can be optimized for the anticipated environments, distances, intruder type, intruder density, etc. As one of ordinary skill in the art will understand, the focus of the invention involves the threshold-based counting methodology, and not the specific count or minimum threshold values which were determined empirically.

For example, in relation to Step 230, it can be defined that the minimum human count threshold is five (5). Therefore, in Step 230, it can be determined whether the count is greater than five in more than one consecutive defined time intervals (e.g., two or more consecutive, two second intervals). If it is determined in Step 230, that the count is greater than the minimum human count threshold for more than one consecutive time intervals, then this would indicate a detected intruder in Step 240. However, if the count never exceeds the minimum human count threshold and/or the count only exceeds the minimum human count threshold for one interval, the process can return to Step 220 to continue counting the number of times the noise threshold is exceeded over the defined time interval.

In Step 250, it can be determined whether the count exceeds a minimum non-human count threshold for more than one consecutive time interval. As discussed, a minimum human count threshold and a minimum non-human count threshold can be defined. By way of example, the non-human count threshold can be defined as one-hundred fifteen (115). Non-human seismic signatures, such as vehicles and tanks are typically stronger; thus, the reason that the count threshold would be defined at a higher value.

For example, in relation to Step 250, the count as determined in Step 220, maybe 125 for a first two-second interval, and 130 for a second (consecutive) two-second interval. Therefore, because both counts exceed the minimum non-human count threshold for more than one consecutive time intervals, the intruder would be identified as non-human in Step 270. However, if the count is 95 for a first two-second interval, and 100 for a second (consecutive) two-second interval, the minimum non-human count threshold would not have been met. Therefore, the intruder would be identified as human in Step 260.

The detection and identification methodology as discussed above with respect to Steps 210-270 illustrate that the identification between a single human and a single vehicle may be relatively simple and can be easily implemented using a low-cost ultra-low powered microcontroller. For example, a single human intruder on a walking path may produce counts of 8 and 11 for two consecutive time intervals, while a large tank may produce counts of 145 and 134 for two consecutive time intervals. For these distinct situations, classification is relatively straightforward. However, a more difficult scenario may present itself when a large group of humans (e.g., 50 troops walking along a road) might be interpreted as a vehicle.

Step 280 resolves these potential scenarios by performing additional analysis to verify the identification results. The additional analysis is used to augment the threshold-based counting methodology to verify and/or correct the initial intruder classification in Steps 260 and 270. In one exemplary embodiment, the amplitude of the seismic signals can be evaluated to determine whether a seismic signal represents a human or non-human intruder. For example, the amplitude of a vehicle signal is much larger than that of a human or groups of humans. Therefore, in Step 280, the process can verify the identification result as defined in Step 260 (i.e., human) or Step 270 (i.e., non-human).

For example, the microcontroller 170, or amplitude evaluation module (not pictured) contained in the microcontroller 170, can evaluate the seismic signals utilized to make the identification determination. The absolute signal amplitude for the seismic signals can be determined and compared to known signal amplitudes. Therefore, if an intruder is classified in Step 270 as non-human (i.e., vehicle); however, the amplitude of the associated signal is much lower than a typical vehicle, the intruder can be re-classified as a human, or most likely a large group of humans, in Step 280.

In an alternative exemplary embodiment, the amplitude evaluation module contained in the microcontroller 170 and discussed with regards to Step 280, can also be utilized to classify different types of human and non-human intruders. For example, a set of amplitude values associated with different types of human and non-human intruders can be predefined. Therefore, in Step 280, after the intruder has been classified as a human or non-human intruder, the process can further classify the particular type of intruder. For human intruders, these types may include a range of the number of humans detected. For example, particular amplitude values may indicate the presence of small (e.g., 1-5 humans), medium (e.g., 20-30 humans), and large (e.g., more than 50 humans groups of intruders). For non-human intruders, these types may include different types of vehicles, such as passenger vehicles, Humvees, and/or tanks. Additional variants might be required to separate airplanes, boat and other vehicles. Furthermore, implementations can be included to separate human signatures from quadrupeds or other false targets.

The predefined values for the amplitude signals can be determined by conducting experiments on different types of humans and non-human and the types of seismic signals that they produce in different environments. These predefined values can be stored in the microcontroller to be used for comparisons in Step 280.

In Step 290, the intruder detection information can be transmitted to a remote location. The intruder detection information can include the location of the particular device that has detected the intruder, a time stamp of when the detection has occurred, and the intruder classification. Furthermore, the seismic signal information related to the detected intruder could also be transmitted. In one embodiment, the intruder detection information can be transmitted by the radio 130. In an alternative embodiment, the intruder detection information can be transmitted by a wireless/satellite network.

It should be noted that within the method 200 of the present invention, the interval sizes, count levels, threshold levels, and noise threshold can all be optimized for a particular application. For example, the time interval used for detection and identification of human foot traffic could be accomplished over a range of time, such as between 0.5 and 4 seconds; however, two seconds is the interval utilized in the examples discussed herein. The two second interval size provides an adequate time for high detection accuracy without using up too much time to allow for a speedy detection. Furthermore, optimal count sizes can be determined for detection and identification for the specific environment, distances and intruders studied. The threshold levels can be automatically adjusted by the system to be as low as possible without causing a high level of false alarms. The noise threshold can be updated at different frequencies which is typically a time that is optimized to be fast enough to change with the background environmental noise. For example, this would typically be in the range of a minute to hours, where the longer times would, for example, compensate for changes in the environmental noise levels between day and night.

Figure 3:
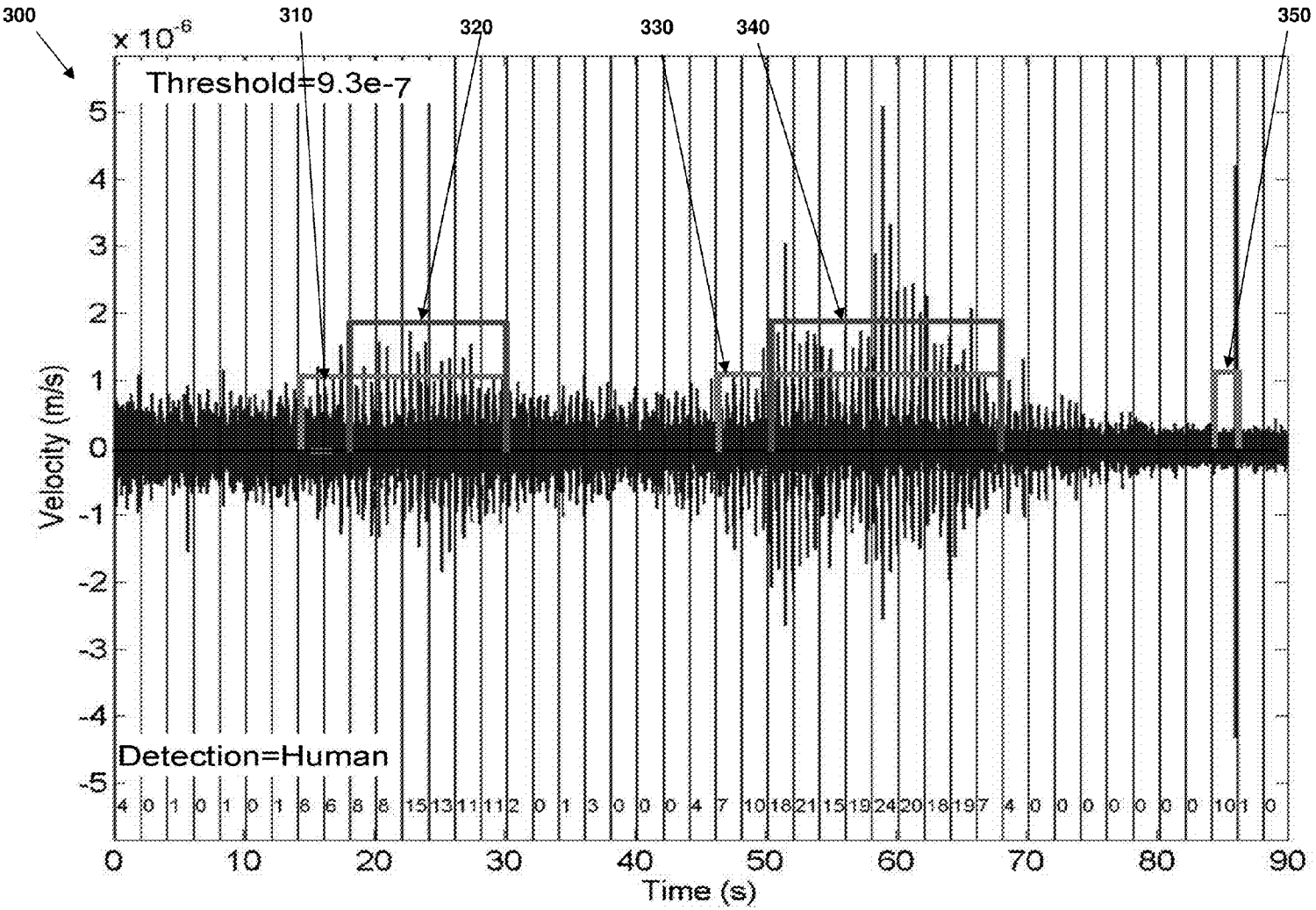
FIG. 3 is an example seismic data chart illustrating a detected human seismic signature in accordance with an exemplary embodiment of the invention.

FIG. 3 is an example seismic data chart illustrating a detected human seismic signature in accordance with an exemplary embodiment of the invention. The particular chart of FIG. 3 represents an example of a seismic signature due to a human passing by a sensor, reversing direction, and passing again at approximately 10 meters. As previously discussed, an initial noise threshold is determined, which is represented in FIG. 3 as 9.3e-7. The system then counts the number of times the noise threshold is exceeded over a defined time interval, which is a two second interval in this example. Along the time axis at the bottom of the chart in FIG. 3, the time and counts for each defined interval (i.e., two-second intervals) are represented. For example, for time 0-2 seconds, there were 4 counts; for time 2-4 seconds, there were 0 counts; for time 4-6 seconds, there was 1 count; etc.

In FIG. 3, the trace 310 indicates when the count number rises above the minimum human threshold, which is defined as five in this example. As can be seen in the Figure, at time 14-16 seconds, the count is 8, and then from time 16-18 seconds, the count is 6. As discussed with respect to Step 230, this represents that the count exceeds a minimum human count threshold value (i.e., five) for more than one consecutive time interval (i.e., two, two-second intervals). Therefore, this indicates that an intruder has been detected; and subsequently, the identification process can be performed. Trace 320 indicates the time from when the intruder has been detected, classified and continues to be present.

After determining that an intruder has been detected at time 18 seconds, the sensor can continue monitoring the seismic signals. For example, as shown in FIG. 3, the count continues to exceed the minimum human count threshold from 18-30 seconds. As discussed with respect to Step 250, the system can determine whether the individual interval counts from 18-30 seconds exceed the minimum non-human threshold. In this example, all the values (i.e., 8, 8, 15, 13, 11, and 12) are all below the non-human threshold; therefore, the intruder can continue to be classified as human.

As noted above, FIG. 3 represents an example where an intruder walked by the sensor and then came back. Trace 330 indicates when the count number rises above the minimum human threshold on the return trip for the intruder, and trace 340 indicates the time from when the intruder has been detected, classified and continues to be present.

In accordance with an exemplary embodiment of the invention, and represented in FIG. 3, the system is successful in avoiding false alarms that plague other purely threshold-based systems. Trace 350 represents a count of 10 from 84-86 seconds. However, even though the count exceeds the minimum human count threshold, it only occurs over one interval. As illustrated, the count is 0 from 82-84 seconds and 1 from 86-88 seconds. Therefore, this seismic reading does not indicate the detection of an intruder. Typically, this type of reading is representative of a short quick seismic signal, such as a falling tree branch, rather than a typical reading of an intruder who is passing through an area. In a simple threshold approach, without the intervals and counting based methods, a false alarm would most likely have been signaled in this situation leading to lost resources and time to investigate a non-intruder.

Figure 4:
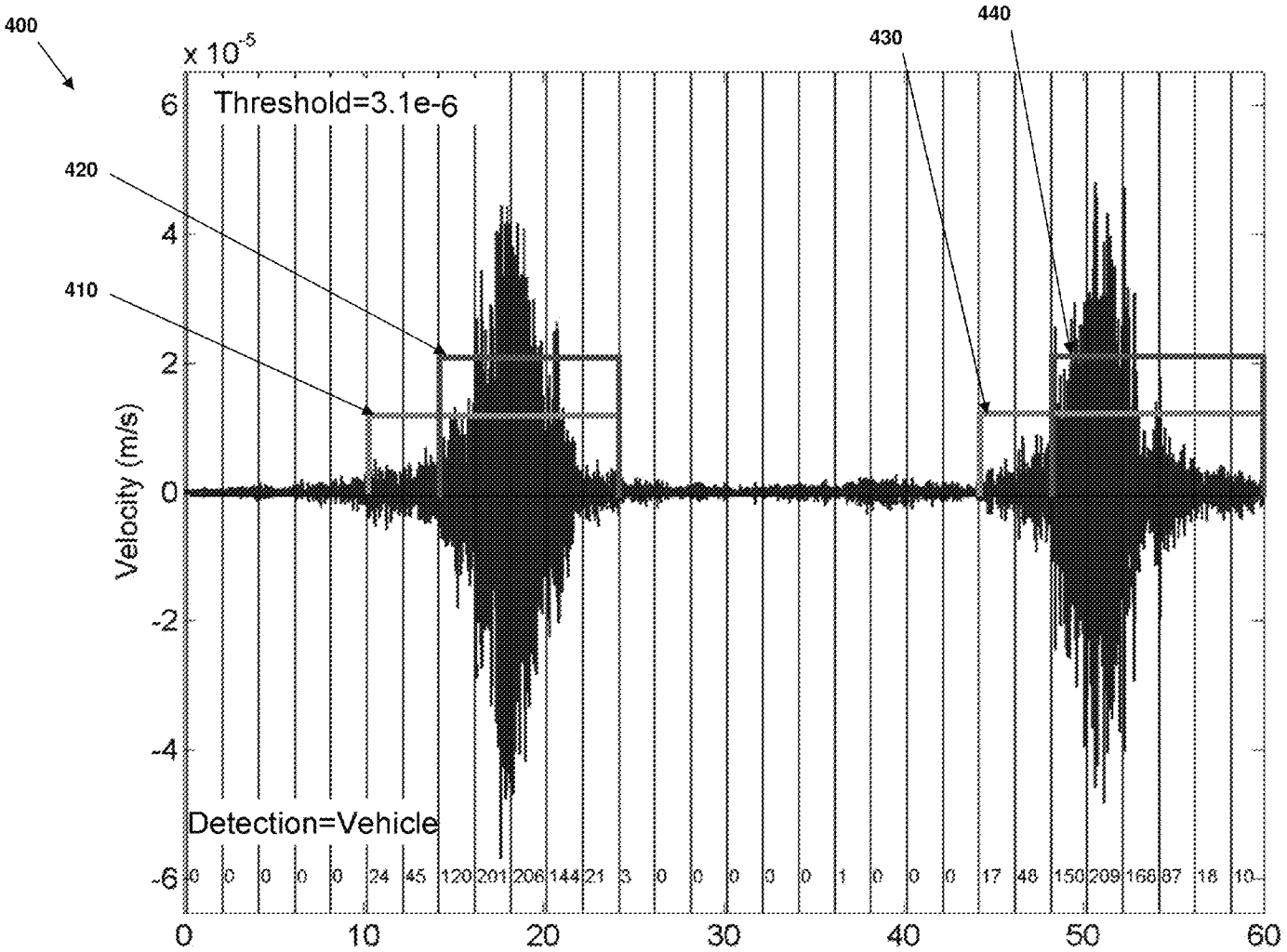
FIG. 4 is an example seismic data chart illustrating a detected non-human seismic signature in accordance with an exemplary embodiment of the invention.

FIG. 4 is an example seismic data chart illustrating a detected non-human seismic signature in accordance with an exemplary embodiment of the invention. The particular chart of FIG. 4 represents an example of a seismic signature due to a vehicle passing by a sensor, reversing direction, and passing again at approximately 10 meters. Similar to FIG. 3, the labeled traces indicate the points of intruder detection and the length of the time the intruder is present, which can then be evaluated to identify the intruder.

Specifically, trace 410 indicates when the minimum human count threshold rises above five and trace 420 indicates the time from when the intruder has been detected, classified and continues to be present. In this example, the difference is in evaluating the counts while the intruder is present from time 12-24 seconds. In FIG. 4, the counts during the presence of the intruder are considerably higher than in FIG. 3 (e.g., 120, 201, 206, 144, and 21). These values are above the minimum non-human count threshold; and therefore, the intruder is classified as a non-human, such as a vehicle. Traces 430 and 440 illustrate the return trip of the vehicle.

Furthermore, FIG. 4 also represents the differences in amplitude between non-human and human intruders. As discussed with respect to Step 280, the amplitudes of the seismic signals can be used to further classify the intruders. The vertical axis represents the velocity, in m/s, of the seismic signals. However, the scales of the vertical axis are different by a magnitude of 10 between FIG. 3 and FIG. 4. For example, the human data represented in FIG. 3 reaches a maximum of approximately $5\times10^{-6}$ m/s, while the non-human data represented in FIG. 4 reaches a maximum of approximately $5\times10^{-5}$ m/s. The non-human, or vehicle, signatures in FIG. 4 are considerably more reactive generating considerably higher levels.

Therefore, as previously discussed, the system can perform an additional analysis on the seismic signal amplitudes to verify that a signal comes from a non-human vehicle source, rather than a large group of humans. Additional analysis can determine a specific type of vehicle, such as a passenger car, Humvee, tank, and even airplanes, helicopters, or boats.

The invention comprises a computer program that can be contained on the microcontroller 270 that embodies the functions described herein and illustrated in the appended flow chart of FIG. 2. However, it should be apparent that there could be many different ways of implementing the invention in computer programming, and the invention should not be construed as limited to any one set of computer program instructions. Further, a skilled programmer would be able to write such a computer program to implement an exemplary embodiment based on the flow charts and associated description in the application text. Therefore, disclosure of a particular set of program code instructions is not considered necessary for an adequate understanding of how to make and use the invention. The inventive functionality of the claimed computer program has been explained in more detail in the preceding description read in conjunction with the figures illustrating the program flow.

It should be understood that the foregoing relates only to illustrative embodiments of the present invention, and that numerous changes may be made therein without departing from the scope and spirit of the invention as defined by the following claims.

The invention claimed is:

1. A method for detecting and classifying intruders, comprising the steps of:

setting a noise threshold by measuring an environmental background noise when no intruder is present, rectifying and averaging the background noise measurement, and applying a multiplier scale;

receiving a plurality of seismic data signals;

counting the number of times the noise threshold is exceeded over a defined time interval by the plurality of seismic data signals;

detecting an intruder based on the count; and classifying the detected intruder based on the count with a microcontroller.

2. The method of claim 1, wherein the step of detecting an intruder based on the count comprises determining whether the count exceeds a minimum human count threshold for more than one consecutive time interval.

3. The method of claim 1, wherein the step of classifying the detected intruder type based on the count comprises the steps of:

determining whether the count exceeds a minimum non-human count threshold for more than one consecutive time interval; and classifying the intruder as human if the count does not exceed a minimum non-human count threshold for more than one consecutive time interval; otherwise, classifying the intruder as non-human if the count does exceed a minimum non-human count threshold for more than one consecutive time interval.

4. The method of claim 1, further comprising the step of performing additional analysis to verify the classification of the detected intruder.

5. The method of claim 4, wherein the step of performing additional analysis to verify the classification of the detected intruder comprises the steps of:

determining an amplitude of the seismic data signals associated with the detected intruder; and comparing the amplitude of the seismic data signals associated with the detected intruder to a set of known signal amplitudes associated with human and non-human intruders.

6. The method of claim 5, further comprising reclassifying the detected intruder if the amplitude of the seismic data signals associated with the detected intruder does not match a known signal amplitude associated with the initial classification of the detected intruder.

7. The method of claim 1, further comprising the step of classifying a sub-type of the detected intruder based on an evaluation of the amplitude of the seismic data signals associated with the detected intruder.

8. The method of claim 1, further comprising the step of transmitting intruder detection information to a remote location.

9. The method of claim 8, wherein the intruder detection information comprises:

intruder location information;

intruder classification information; and a time stamp of when the intruder was detected.

10. A system for detecting and classifying intruders, comprising:

a seismic sensor configured to receive a plurality of seismic data signals;

a microcontroller configured to set a noise threshold by measuring an environmental background noise when no intruder is present, rectifying and averaging the background noise measurement, and applying a multiplier scale; count the number of times the noise threshold is exceeded over a defined time interval by the plurality of seismic data signals; detect an intruder based on the count; and classify the detected intruder based on the count;

and a transmission source configured to transmit intruder detection and classification information to a remote location.

11. The system of claim 10, further comprising a power cell configured to supply power to the microcontroller and transmission source.

12. The system of claim 10, wherein the microcontroller is implemented in a computer system that comprises instructions stored in a machine-readable medium and a processor that executes the instructions.

13. The system of claim 10, wherein the microcontroller further comprises an amplitude evaluation module configured to determine a signal amplitude for the seismic data signals associated with the detected intruder and compare the detected intruder signal amplitude to known signal amplitudes.

* * * * *